US009625088B1

(12) United States Patent
Tan

(10) Patent No.: US 9,625,088 B1
(45) Date of Patent: Apr. 18, 2017

(54) HOOK HANGER FOR SPORTS BAG

(71) Applicant: Fu-Hsing Tan, Taoyuan Hsien (TW)

(72) Inventor: Fu-Hsing Tan, Taoyuan Hsien (TW)

( * ) Notice: Subject to any disclaimer, the term of this patent is extended or adjusted under 35 U.S.C. 154(b) by 0 days.

(21) Appl. No.: 14/996,952

(22) Filed: Jan. 15, 2016

(51) Int. Cl.
*A47B 96/06* (2006.01)
*F16M 13/02* (2006.01)
*A63B 55/00* (2015.01)

(52) U.S. Cl.
CPC ..... *F16M 13/02* (2013.01); *A63B 55/00* (2013.01)

(58) Field of Classification Search
CPC ..... A47F 5/0006; A63B 55/40; A63B 55/00; A63B 55/408; F16M 13/02; F16B 45/00
USPC ..... 248/213.2, 215, 339, 322, 95, 96, 100, 248/690, 691, 294.1, 304–307; 206/315, 206/3, 315.3
See application file for complete search history.

(56) References Cited

U.S. PATENT DOCUMENTS 5,924,667 A * 7/1999 Grahn ..... F16B 45/00 248/304
7,175,143 B1 * 2/2007 Ho ..... A47G 29/083 248/215

* cited by examiner

*Primary Examiner* — Todd M Epps

(57) ABSTRACT

A hook hanger includes a mounting member, a hook member and a spring member connected between a first connection portion of the mounting member and a second locating portion of the hook member such that the base of the mounting member and the narched hook body of the hook member define therebetween a contained angle after installation of the mounting member in a sports bag; the hook member is forced by the torsional force of the spring member to stop against the outer wall of the sports bag; the hook member can be flexibly biased in direction away from the sports bag for the hanging of an umbrella, towel or any other item and then automatically pressed by the hook member against the sports bag subject to the effect of the torsional force of the spring member.

6 Claims, 11 Drawing Sheets

A-A

HOOK HANGER FOR SPORTS BAG

BACKGROUND OF THE INVENTION

1. Field of the Invention

The present invention relates to hook hanger technology and more particularly, to a hook hanger for sports bag, which uses a spring member to connect a mounting member and a hook member, enabling the hook member to be forced by the torsional force of the spring member to press on the sports bag, facilitating placement and removal of an umbrella, towel or any other personal item.

2. Description of the Related Art

A golf bag generally has a ring hanger located at the outer wall thereof for the hanging of an umbrella or towel, and a pocket located at the outer wall and spaced below the ring hanger for holding the front tip of the shaft of the umbrella that is inserted into the ring hanger. However, the ring hanger has no function to secure the placed umbrella or towel firmly in place. When the golf bag is being moved, the umbrella or towel can easily be forced out of the ring hanger. Further, when placing an umbrella in the ring hanger or removing it from the ring hanger, the user needs to insert the umbrella downwardly through the ring hanger or to pull the umbrella upwardly from the ring hanger, complicating the use.

SUMMARY OF THE INVENTION

The present invention has been accomplished under the circumstances in view. It is therefore the main object of the present invention to provide a hook hanger for sports bag, which utilizes the torsional force of a spring member to force a hook member against the sports bag, facilitating placement or removal of an umbrella, towel or any other personal item.

It is another object of the present invention to provide a hook hanger, which utilizes the flexibly biasing function of the hook member for enabling the user to pull the umbrella toward the stop block of the hook member and then to open the hook member from the sports bag, facilitating removal of the umbrella from the hook member.

To achieve these and other objects of the present invention, a hook hanger for sports bag comprises a mounting member, a hook member and a spring member. The mounting member comprises a base for fixation to an outer wall of a golf bag, a first connection portion extended from a bottom side of the base and a first accommodation chamber defined in the first connection portion. The hook member comprises an arched hook body, a second locating portion located at one end of the arched hook body, a stop block located at an opposite end of the arched hook body, and a second accommodation chamber defined in the second locating portion. The spring member comprises a coiled spring body, a first locating eyelet located at one end of the coiled spring body, and a second locating eyelet located at an opposite end of the coiled spring body. The coiled spring body comprises a middle segment, a first hidden segment located at one end of the middle segment, and a second hidden segment located at an opposite end of the middle segment. The first hidden segment and the second hidden segment are respectively received in the first accommodation chamber and the second accommodation chamber. The first locating eyelet and the second locating eyelet are respectively fixedly secured to the bottom side of the first accommodation chamber and the bottom side of the second accommodation chamber. The middle segment is exposed to the outside of the mounting member and the hook member between the first connection portion and the second locating portion. The spring member is connected between the first connection portion of the mounting member and the second locating portion of the hook member. The base of the mounting member and the arched hook body of the hook member define therebetween a contained angle so that after installation of the hook hanger in a sports bag, the spring force of the spring member forces the stop block of the hook member to stop against the sports bag, causing the creation of a receiving space between the arched hook body of the hook member and the sports bag.

The mounting member further comprises a first locating groove located in the bottom side of the first accommodation chamber, a first through hole cut through the first connection portion across the first locating groove. The first locating eyelet of the spring member is inserted into the first locating groove and kept in alignment with the first through hole for the mounting of a fastening member to fixedly secure the first locating eyelet to the mounting member. The hook member further comprises a second locating groove located in the bottom side of the second accommodation chamber, and a second through hole cut through the second locating portion across the second locating groove. The second locating eyelet of the spring member is inserted into the second locating groove and kept in alignment with the second through hole for the mounting of a fastening member to fixedly secure the second locating eyelet to the hook member. Further, the outer diameter of the first hidden segment of the spring member is smaller than the inner diameter of the first accommodation chamber. The first hidden segment and the first accommodation chamber define therebetween a first annular gap. The outer diameter of the second hidden segment of the spring member is smaller than the inner diameter of the second accommodation chamber. The second hidden segment and the second accommodation chamber define therebetween a second annular gap.

Subject to the aforesaid technical features of the invention, the invention significantly increase the length of the spring action of the spring member and the space for the movement of the hook member, enabling the hook member to be flexibly biased relative to the mounting member and the sports bag for the placement or removal of a towel, umbrella or any other personal item.

DETAILED DESCRIPTION OF THE PREFERRED EMBODIMENT

Figure 1:
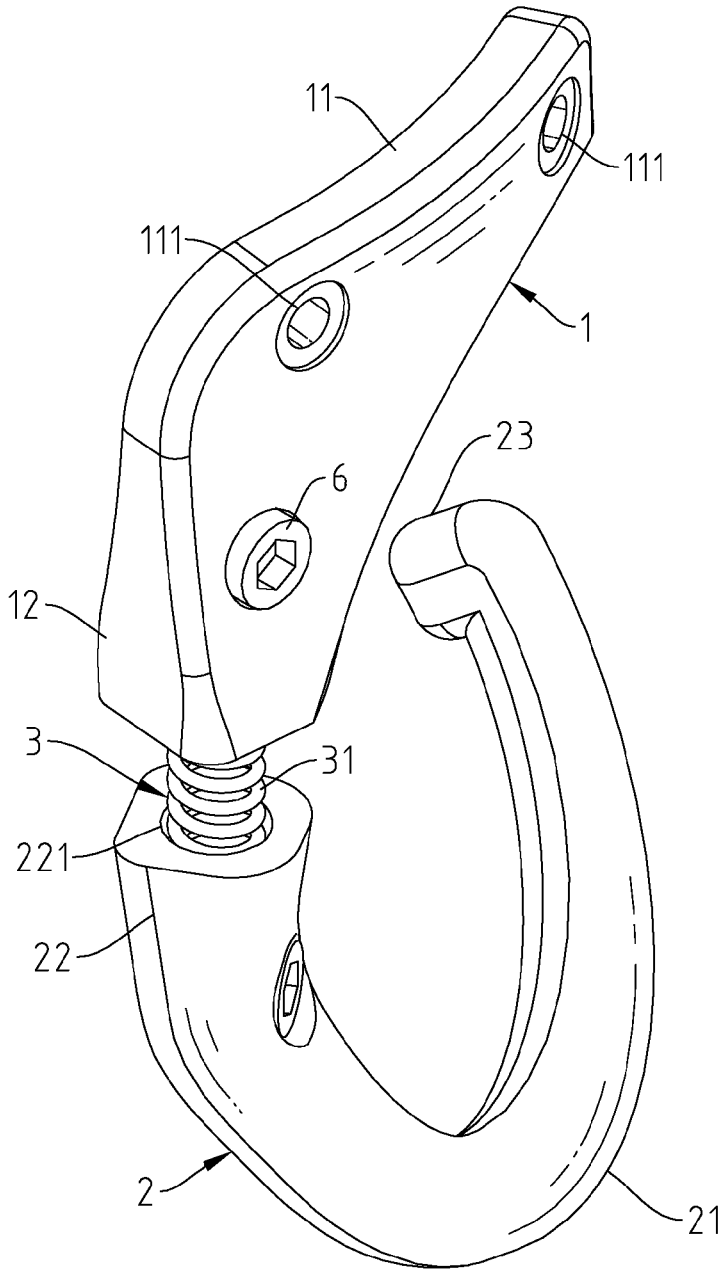
FIG. 1 is an oblique top elevation of a hook hanger for sports bag in accordance with the present invention.
Figure 2:
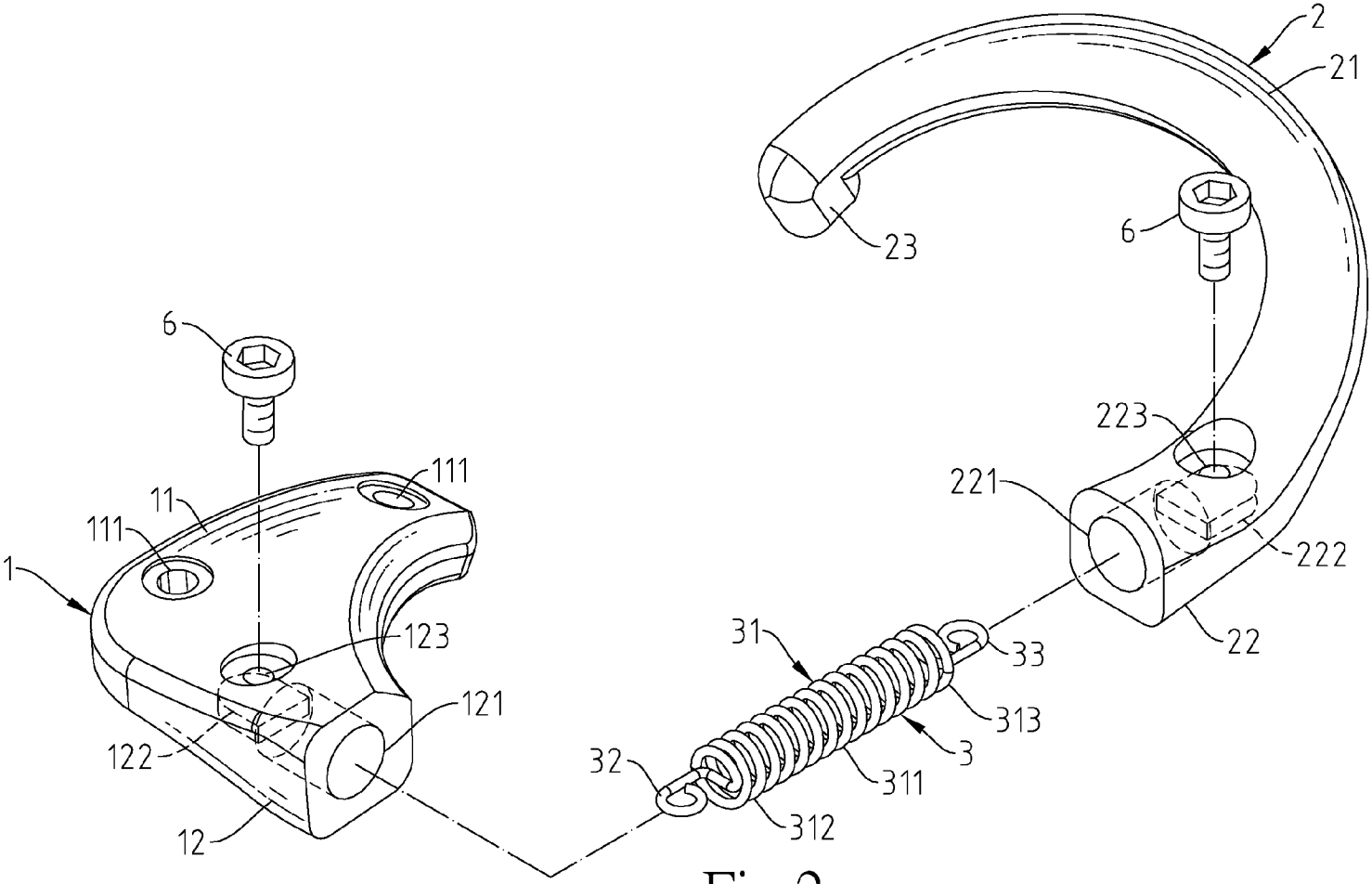
FIG. 2 is an exploded view of the hook hanger in accordance with the present invention.
Figure 3:
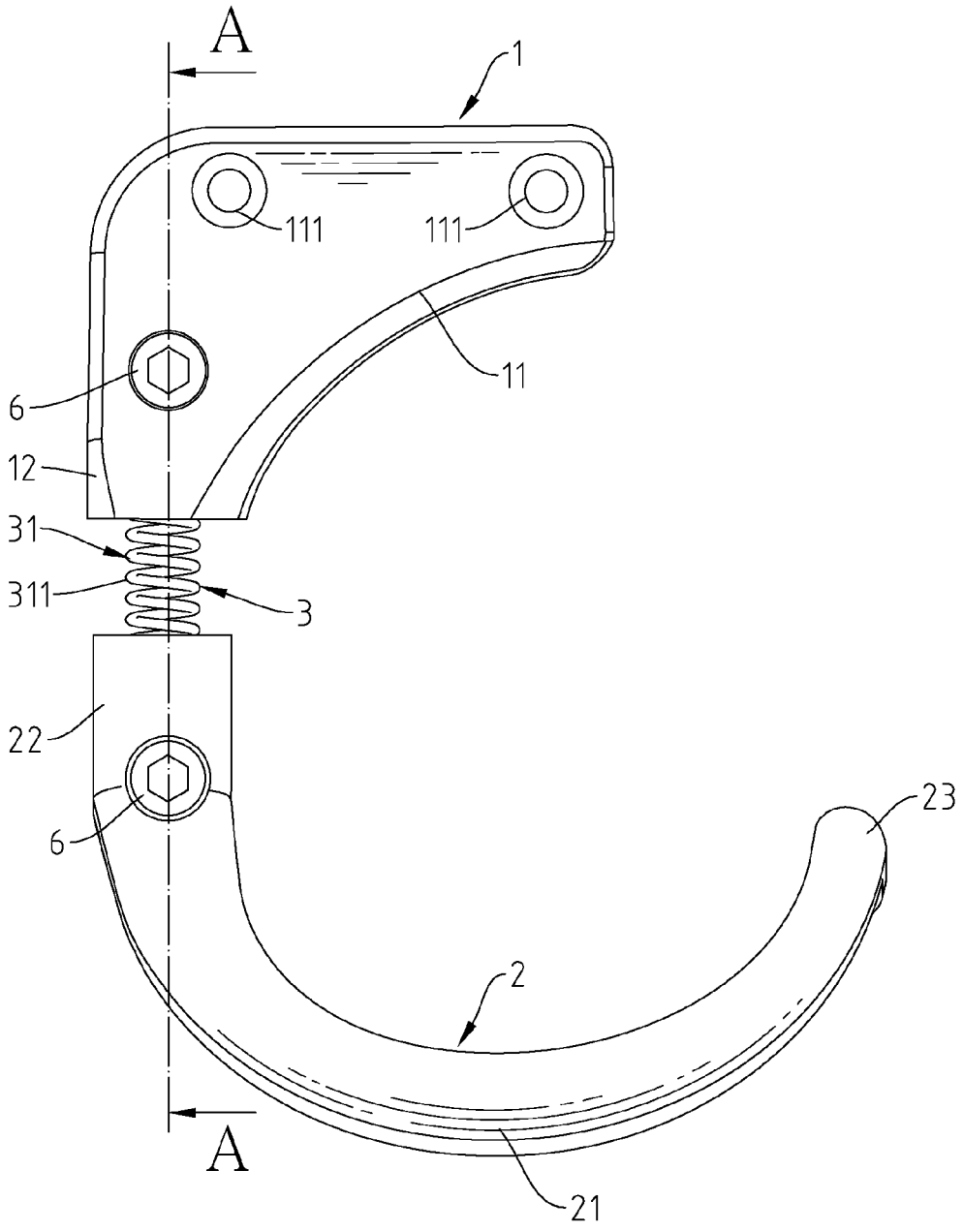
FIG. 3 is a front view of the hook hanger in accordance with the present invention.
Figure 4:
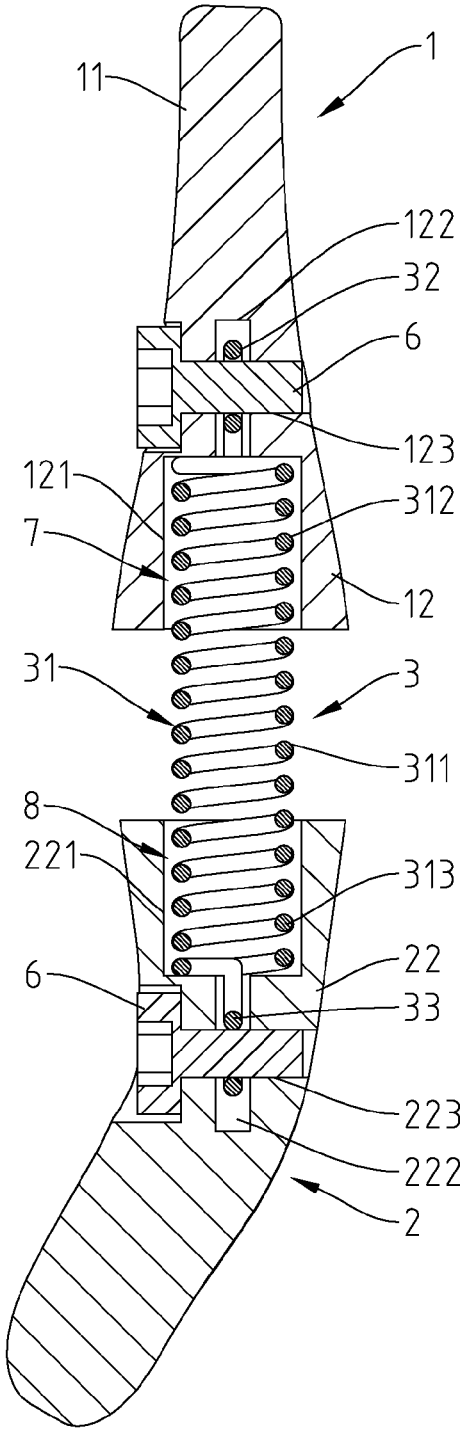
FIG. 4 is a sectional view taken along line A-A of FIG. 3.
Figure 5:
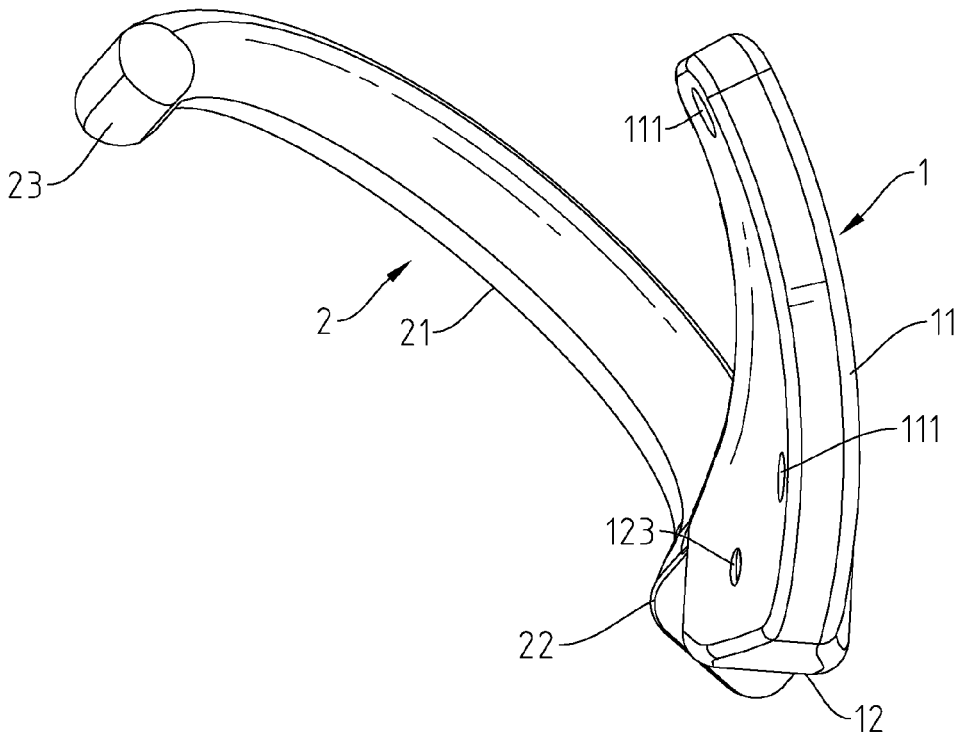
FIG. 5 is a top view of the hook hanger in accordance with the present invention.
Figure 6:
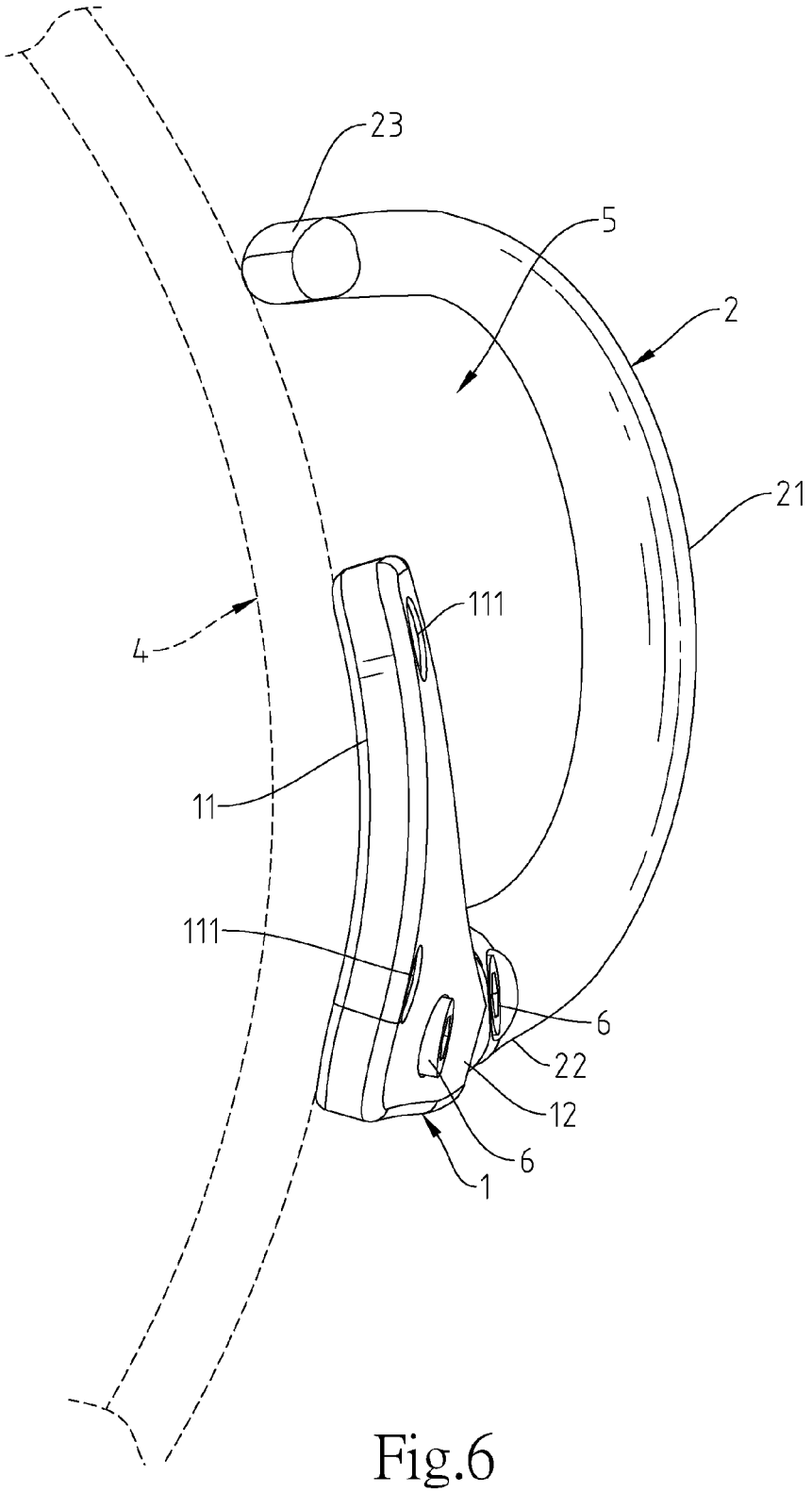
FIG. 6 is a schematic top view illustrating the hook hanger of the present invention installed in a golf bag.

Referring to FIGS. 1-6, a hook hanger for sports bag in accordance with the present invention is shown. The hook hanger for sports bag comprises a mounting member 1, a hook member 2 located at a bottom side of the mounting member 1, and a spring member 3 connected between the mounting member 1 and the hook member 2.

The mounting member 1 comprises a base 11, a plurality of mounting holes 111 cut through opposing front and back sides of the base 11 for fixation to the outside wall of a sports bag, for example, golf bag 4, a first connection portion 12 downwardly extended from a bottom side of the base 11, a first accommodation chamber 121 defined in the first connection portion 12, a first locating groove 122 located in a bottom side of the first accommodation chamber 121, and a first through hole 123 cut through the opposing front and back sides of the first connection 20 port ion 12 across the first locating groove 122.

The hook member 2 comprises an arched hook body 21, a second locating portion 22 located at one end of the arched hook body 21, a stop block 23 located at an opposite end of the arched hook body 21, a second accommodation chamber 221 defined in the second locating portion 22, a second locating groove 222 located in a bottom side of the second accommodation chamber 221, and a second through hole 223 cut through the second locating portion 22 across the second locating groove 222.

The spring member 3 in this embodiment is a torsion spring, comprising a coiled spring body 31, a first locating eyelet 32 located at one end of the coiled spring body 31, and a second locating eyelet 33 located at an opposite end of the coiled spring body 31. The coiled spring body 31 defines a middle segment 311, and first hidden segment 312 and second hidden segment 313 respectively located at two opposite ends of the middle segment 311. The outer diameter of the first hidden segment 312 and the second hidden segment 313 is smaller than the inner diameter of the first accommodation chamber 121 and the inner diameter of the second accommodation chamber 221. The first hidden segment 312 and the second hidden segment 313 are respectively inserted into the first accommodation chamber 121 and the second accommodation chamber 221, so that a first annular gap 7 and a second annular gap 8 are respectively defined in the first accommodation chamber 121 and the second accommodation chamber 221 around the first hidden segment 312 and the second hidden segment 313. The first locating eyelet 32 and the second locating eyelet 33 are respectively inserted into the first locating groove 122 and the second locating groove 222, and respectively kept in alignment with the first through hole 123 and the second through hole 223 for the mounting of a fastening member 6 to fixedly and respectively secure the first locating eyelet 32 and the second locating eyelet 33 to the mounting member 1 and the hook member 2, suspending the middle segment 311 on the outside between the first connection portion 12 and the second locating portion 22. The aforesaid spring member 3 is connected between the first connection portion 12 of the mounting member 1 and the second locating portion 22 of the hook member 2. Further, before installation of the mounting member 1 in the golf bag 4, the base 11 of the mounting member 1 and the arched hook body 21 of the hook member 2 define therebetween a contained angle. When fastening the mounting member 1 to the golf bag 4, the stop block 23 of the hook member 2 is biased by the spring member 3 to press on the golf bag 4, allowing the creation of a receiving space 5 between the arched hook body 21 of the hook member 2 and the golf bag 4.

Figure 7:
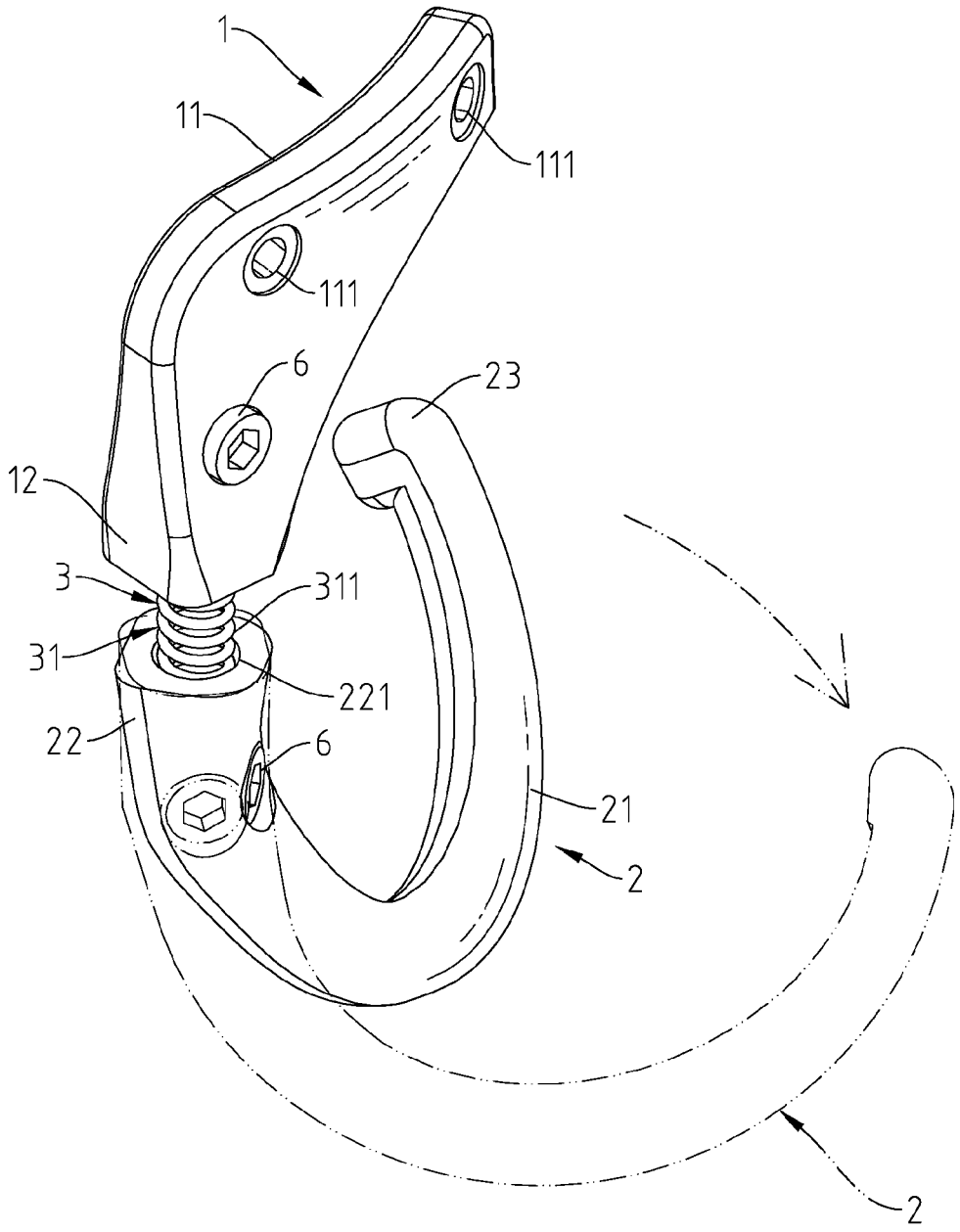
FIG. 7 is a schematic drawing of the invention, illustrating biasing of the hook member relative to the mounting member.

Referring to FIG. 7, as illustrated, the spring member 3 is connected between the mounting member 1 and the hook member 2, allowing the hook member 2 to be biased between an open position and a close position subject to the functioning of the spring member 3.

Figure 8:
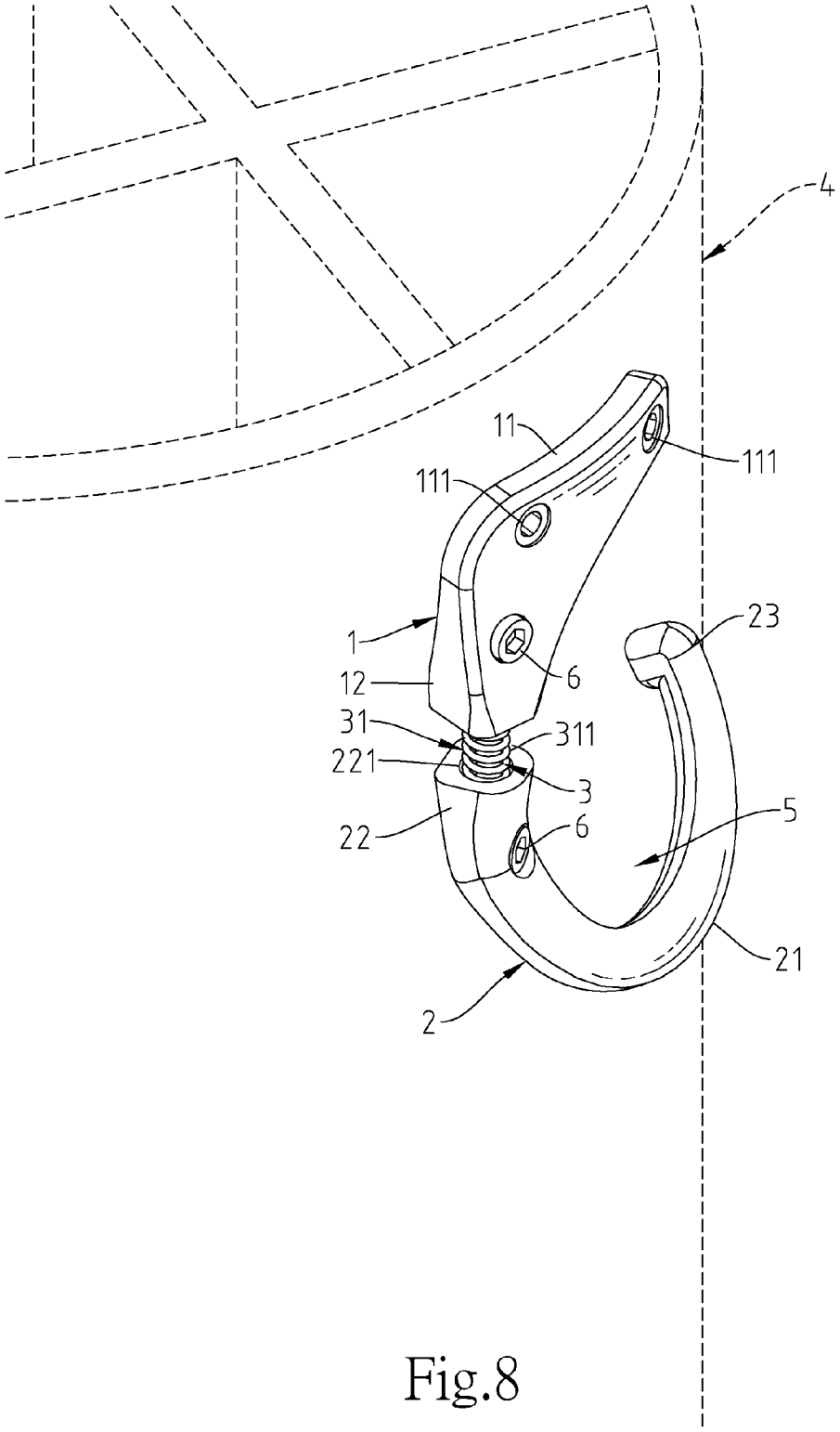
FIG. 8 is a schematic drawing illustrating installation of the hook hanger in a golf bag (I).
Figure 9:
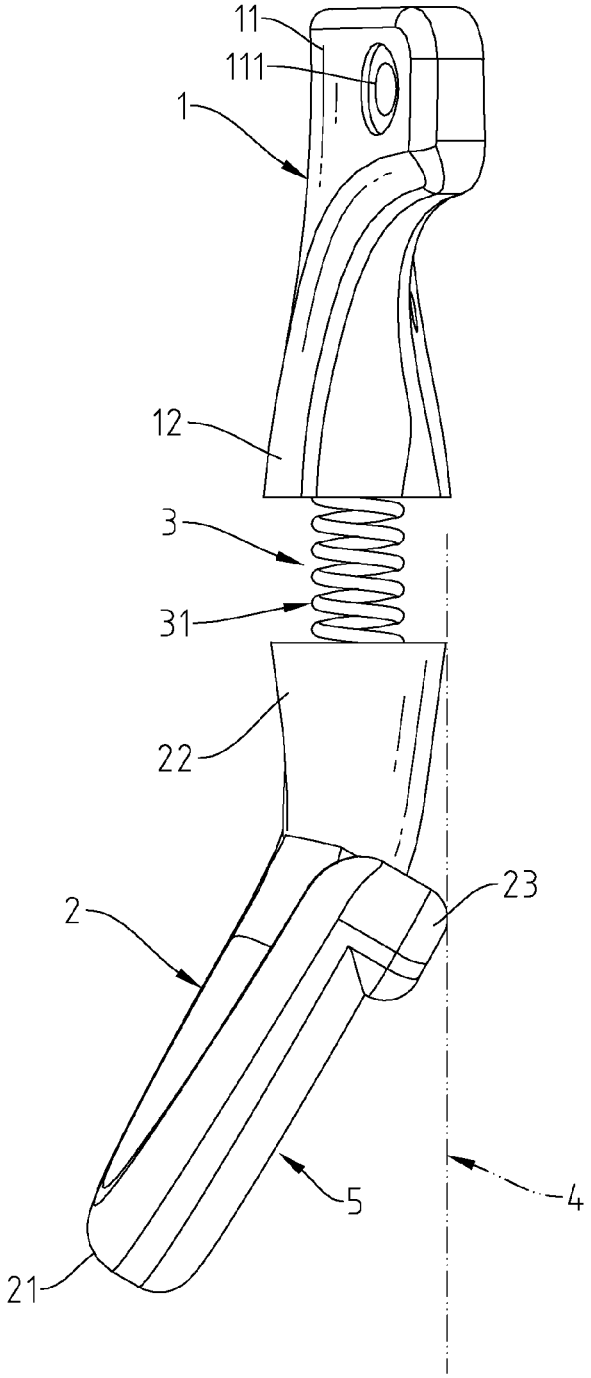
FIG. 9 is a schematic drawing illustrating installation of the hook hanger in the golf bag (II).

Referring to FIGS. 8 and 9, the mounting member 1 is affixed to the golf bag 4; the hook member 2 is disposed at the bottom side of the mounting member 1; the spring member 3 is connected between the mounting member 1 and the hook member 2 with the middle segment 311 thereof exposed to the outside between the first connection portion 12 of the mounting member 1 and the second locating portion 22 of the hook member 2. Subject to the torsional force of the spring member 3, the hook member 2 is forced to press on the golf bag 4. As illustrated in FIG. 9, the base 11 of the mounting member 1 and the arched hook body 21 of the hook member 2 define therebetween a contained angle; subject to the torsional force of the spring member 3, the stop block 23 of the hook member 2 is forced to stop against the golf bag 4 with the receiving space 5 defined between the arched hook body 21 of the hook member 2 and the golf bag 4.

Figure 10:
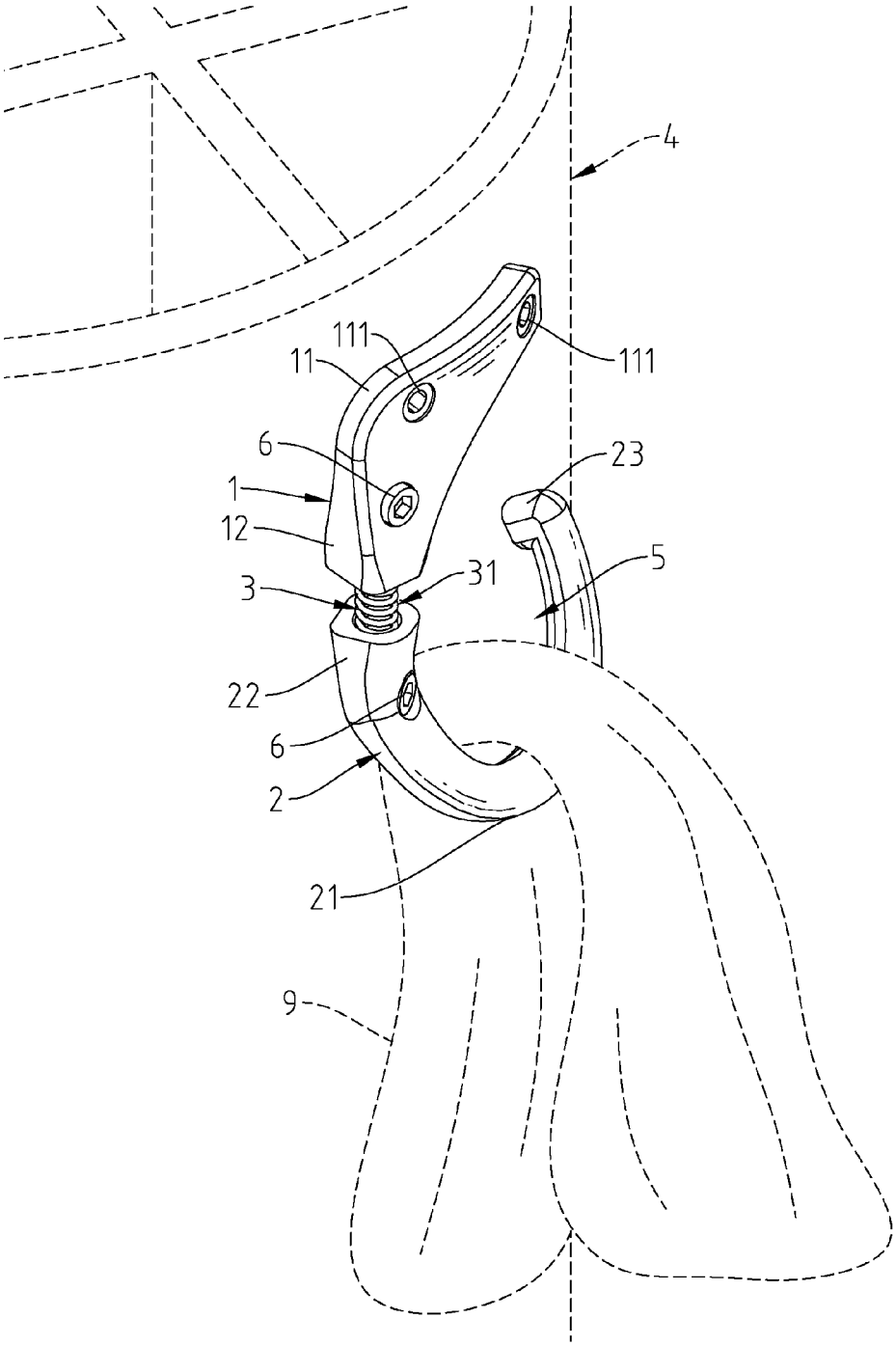
FIG. 10 illustrates an application example of the present invention.
Figure 11:
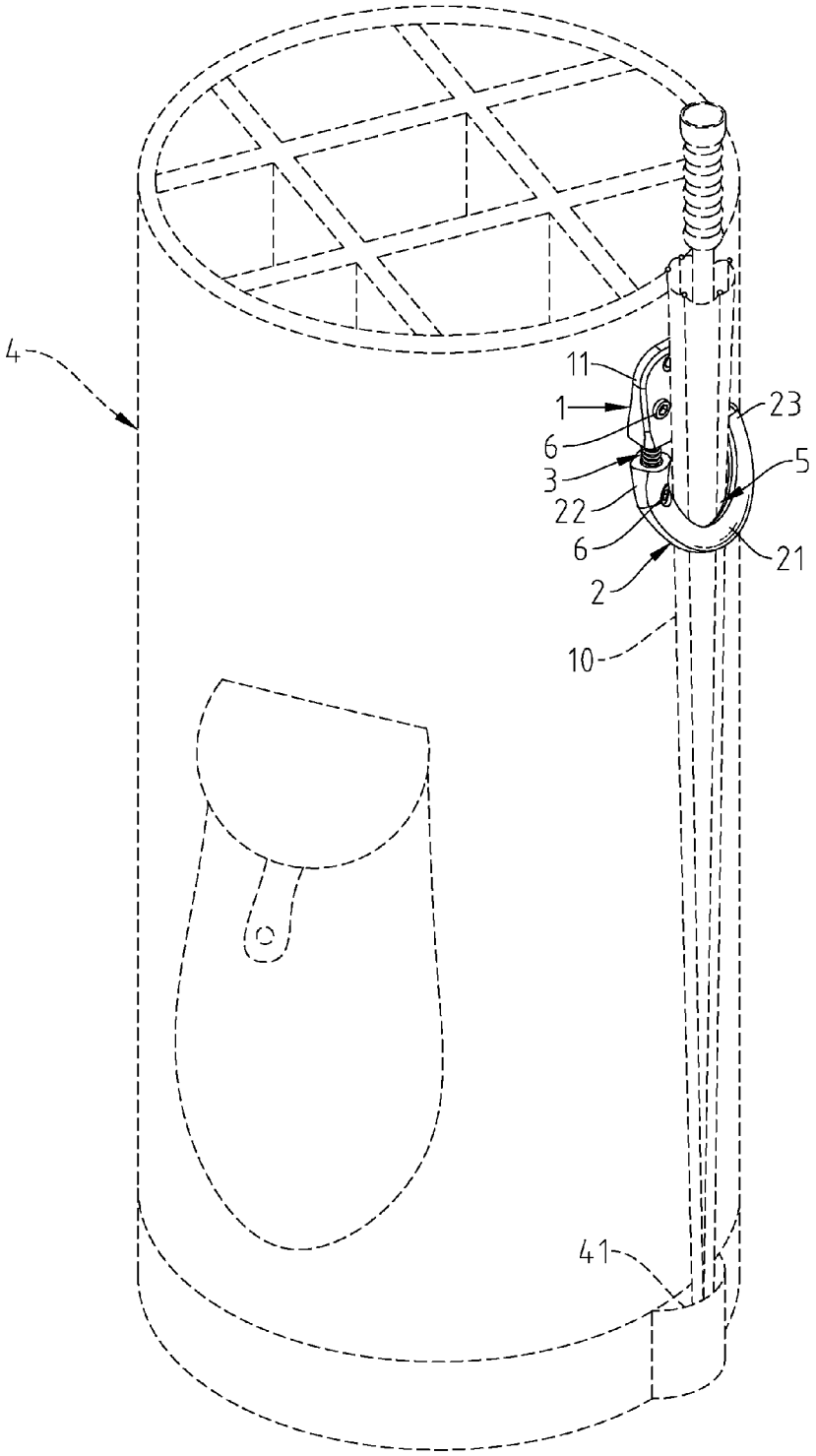
FIG. 11 illustrates another application example of the present invention.

Referring to FIGS. 10 and 11, in application, the user can insert a towel 9 through the receiving space 5 between the arched hook body 21 of the hook member 2 and the golf bag 4 and positively hang on the towel 9 on the hook member 2, or, the user can pull open the hook member 2 from the golf bag 4 and then set the towel 9 in between the hook member 2 and the golf bag 4, enabling the towel 9 to be held in the contained angle between the mounting member 1 and the hook member 2 and stopped by the hook member 2 against the golf bag 4 subject to the torsional forcer of the spring member 3. Further, the user can insert an umbrella 10 upwardly through the receiving space 5 between the arched hook body 21 of the hook member 2 and the golf bag 4 into the inside of the hook member 2, or pull the hook member 2 outwardly from the golf bag 4 and then insert the umbrella 10 into the receiving space 5 between the arched hook body 21 of the hook member 2 and the golf bag 4, enabling the front tip of the shaft of the umbrella 10 to be received in a pocket 41 near the bottom side of the golf bag 4 and the opposing rear end of the shaft of the umbrella 10 to be pressed by the hook member 2 on the golf bag 4 subject to effect of the torsional force of the spring member 3. When going to remove the towel 9 or umbrella 10 from the space between the hook member 2 and the golf bag 4, open the hook member 2 from the golf bag 4 and the take the towel 9 or umbrella 10 from the hook member 2, or, directly pull the towel 9 from the space between the hook member 2 and the golf bag 4, or, pull the umbrella 10 in direction toward the stop block 23 of the hook member 2 and then remote the umbrella 10 from the hook member 2 without pulling the umbrella 10 in direction from the top side toward the bottom side.

In conclusion, the invention provides a hook hanger for sports bag that effectively eliminates the drawbacks of the prior art design subject to the technical features that: the spring member 3 is connected between the first connection portion 12 of the mounting member 1 and the second locating portion 22 of the hook member 2 with a contained angle defined between the base 11 of the mounting member 1 and the arched hook body 21 of the hook member 2 before installation of the mounting member 1 in a golf bag 4, so that the stop block 23 of the hook member 2 can be forced by the torsional force of the spring member 3 to stop against the outer surface of the golf bag 4 after installation of the mounting member 1 in a golf bag 4; the outer diameter of the first hidden segment 312 and second hidden segment 313 of the spring member 3 is smaller than the inner diameter of the first accommodation chamber 121 and the inner diameter of the second accommodation chamber 221; the first hidden segment 312 and the second hidden segment 313 are respectively received in the first accommodation chamber 121 and the second accommodation chamber 221 with a first annular gap 7 and a second annular gap 8 respectively defined in the first accommodation chamber 121 and the second accommodation chamber 221 around the first hidden segment 312 and the second hidden segment 313 and the middle segment 311 exposed to the outside of the mounting member 1 and the hook member 2 between the first connection portion 12 and the second locating portion 22, and thus, the length of the spring action of the spring member 3 and the space for the movement of the hook member 2 is significantly increased, enabling the hook member 2 to be flexibly biased relative to the mounting member 1 and the golf bag 4 for the placement or removal of a towel 9 or umbrella 10 or any other personal item.

What is claimed is:

1. A hook hanger for a sports bag, comprising:

a mounting member comprising a base for fixation to an outer wall of the sports bag, a first connection portion extending from a bottom side of said base and a first accommodation chamber defined in said first connection portion;

a hook member comprising an arched hook body, a second locating portion located at one end of said arched hook body, a stop block located at an opposite end of said arched hook body and a second accommodation chamber defined in said second locating portion; and a spring member comprising a coiled spring body, a first locating eyelet located at one end of said coiled spring body and a second locating eyelet located at an opposite end of said coiled spring body, said coiled spring body comprising a middle segment, a first hidden segment located at one end of said middle segment and a second hidden segment located at an opposite end of said middle segment, said first hidden segment and said second hidden segment being respectively received in said first accommodation chamber and said second accommodation chamber, said first locating eyelet and said second locating eyelet being respectively fixedly secured to a bottom side of said first accommodation chamber and a bottom side of said second accommodation chamber, said middle segment being exposed to an outside of said mounting member and said hook member between said first connection portion and said second locating portion;

wherein said spring member is connected between said first connection portion of said mounting member and said second locating portion of said hook member, said base of said mounting member and said arched hook body of said hook member defining therebetween a contained angle so that after installation of the hook hanger in the sports bag, a spring force of said spring member forces said stop block of said hook member to stop against said sports bag, causing creation of a receiving space between said arched hook body of said hook member and said sports bag.

2. The hook hanger as claimed in claim 1, wherein said mounting member further comprises a first locating groove located in the bottom side of said first accommodation chamber, a first through hole cut through said first connection portion across said first locating groove, said first locating eyelet of said spring member inserted into said first locating groove and kept in alignment with said first through hole for the mounting of a fastening member to fixedly secure said first locating eyelet to said mounting member.

3. The hook hanger as claimed in claim 1, wherein said hook member further comprises a second locating groove located in the bottom side of said second accommodation chamber, and a second through hole cut through said second locating portion across said second locating groove said second locating eyelet of said spring member inserted into said second locating groove and kept in alignment with said second through hole for the mounting of a fastening member to fixedly secure said second locating eyelet to said hook member.

4. The hook hanger as claimed in claim 1, wherein an outer diameter of said first hidden segment of said spring member is smaller than an inner diameter of said first accommodation chamber said first hidden segment and said first accommodation chamber defining therebetween a first annular gap.

5. The hook hanger as claimed in claim 1, wherein an outer diameter of said second hidden segment of said spring member is smaller than an inner diameter of said second accommodation chamber said second hidden segment and said second accommodation chamber defining therebetween a second annular gap.

6. The hook hanger as claimed in claim 1, wherein said spring member is a torsion spring.

* * * * *